US006347665B2

(12) United States Patent
Rogers

(10) Patent No.: US 6,347,665 B2
(45) Date of Patent: Feb. 19, 2002

(54) SNUBBING UNIT TONG APPARATUS

(76) Inventor: Tommie L Rogers, 702 Crestlawn, Lafayette, LA (US) 70502

( * ) Notice: Subject to any disclaimer, the term of this patent is extended or adjusted under 35 U.S.C. 154(b) by 0 days.

(21) Appl. No.: 09/730,203

(22) Filed: Dec. 5, 2000

Related U.S. Application Data

(63) Continuation of application No. 09/263,053, filed on Mar. 5, 1999, now Pat. No. 6,213,216.

(51) Int. Cl.[7] ..... E21B 19/18
(52) U.S. Cl. ..... 166/77.51; 166/77.4; 166/78.1
(58) Field of Search ..... 166/78.1, 77.4, 166/77.51, 379, 380, 383

(56) References Cited

U.S. PATENT DOCUMENTS 3,677,345 A * 7/1972 Sizer ..... 166/315
3,881,375 A * 5/1975 Kelly ..... 81/57.35
5,390,568 A * 2/1995 Pietras ..... 81/57.16
6,158,516 A 12/2000 Smith et al. ..... 166/385

* cited by examiner

*Primary Examiner*—David Bagnell
*Assistant Examiner*—Zakiya Walker
(74) *Attorney, Agent, or Firm*—Jesse D. Lambert

(57) ABSTRACT

A power tong set, with lead and back-up tongs, is mounted on the slip bowl of the traveling jack head of a snubbing unit and rotates with the slip bowl. Service lines (or umbelicals) for the tong set are not connected during string rotation. In an alternate version of the apparatus a fluid feed through swivel is mounted on the tong set, secured to the necessary tong operating and control service fluid line, or lines, such that the tong set can rotate with tong service lines between the tong set and the snubbing unit attached during rotation. In an alternate form, the tong set is mounted on the jack head, independently of the rotary table, and the tong set does not rotate when the rotary table rotates.

2 Claims, 1 Drawing Sheet

SNUBBING UNIT TONG APPARATUS

This application is a continuation of application Ser. No. 09/263,053 filed Mar. 5, 1999, now U.S. Pat. No. 6,213,216.

This invention pertains to operations using snubbing units on well and mounting power tongs atop the traveling jack head of the snubbing unit for the purpose of making and breaking connections on tubular strings suspended in wells.

BACKGROUND

Petroleum related wells, and the like, usually have a tubular string suspended inside a cemented-in casing string that requires special handling during rework, and some other operations. Producing wells often have casing pressures. If the suspended tubular string is pressure sealed to the casing, it behaves as a long piston and the casing pressure can blow the tubular string from the well. To conduct work on such wells a snubbing unit is used. The snubbing unit can secure the tubular string from slipping in either axial direction and can move it in either axial direction. Usually, the snubbing unit is also capable of rotating the string in the well while moving the string in either axial direction.

The bore of the tubular string is closed to the casing pressure before work starts by valves or plugs in the string so that the string can be safely opened during connections.

Before work on the tubular string can begin the casing is sealed from atmosphere by a series of blowout preventers that can each close on and seal a particular size pipe. The greater the number of distinct tubular sizes in the string, the greater the number of blowout preventers required.

The snubbing unit is usually secured to the well head and may be supported solely by the well head or at least partly by a separately prepared structure resting on the earth around the well. The snubbing unit has a base platform fitted with at least one slip bowl and slips to support the string against force in either axial direction. In many cases the stationary slip bowl is a dual bowl arrangement with the dual bowls oppositely oriented with slips to hold in both axial directions. The slips may differ from those usually on rotary rigs in that they can be forced closed without the need for string weight to provide the slip closing force.

The following descriptive material will be directed to adding length to the string, and conducting related activity. Removing string from the well requires alteration of the process but that alteration is well known to those skilled in the art. It will be understood that the same apparatus and basic procedures will work string in either direction as required.

The snubbing unit has a jack mechanism that moves a jack head, situated above the basic platform, axially along the extended well axis. The jack head serves the function of a rig traveling block with the exception that the jack head can push up or pull down on the string. The jack head carries a powered rotary table. The rotary table has a slip bowl with slips that can act in either axial direction or it has two slip bowls, one oriented in each axial direction.

At the present time it is commonplace to move a power tong assembly, usually containing both back-up and lead tongs, into work position around the string and away from the string to clear the work area. In some cases the same power tong assembly is used near the base platform and then hoisted up to operate above the jack head. Around the most dangerous of industrial activity such movements are undesirable.

When practical, hoisting work around a snubbing activity is done with mobile cranes. In some cases, however, the hoist rig comprises a spar mounted on the well head, directly or indirectly, and fitted with a winch and line for lifting. Such arrangements urge minimization of the lifting and load handling demands.

There is a need to reduce or eliminate human activity on the jack head. An immediate step is to secure the tong set to an adapter plate on the slip bowl. The tong set has to rotate if the slip bowl is rotated. The tong set is never in use while the string is rotated in the well and the tongs can be disconnected from umbelicals and allowed to rotate. Hydraulic and electrical quick couplers remove the challenge from rapid connection and disconnection of the umbelicals to the tong set. That mounting feature is an objective and at least one point of novelty in this invention.

Allowing the tong set to rotate is not a desirable feature in itself but it is expedient with present snubbing unit designs. Further, that overcomes known problems with mounting tongs on the jack head.

An optional feature, an objective and a point of novelty, for the tong arrangement is a mounting structure that permits mounting of the tong set on the jack head structure. The tong set then does not rotate with the slip bowl and the tong umbelicals can remain connected. With that arrangement it is possible to remove the operating personnel from the jack head during routine pipe string working activity. That is a safety feature of substance.

These and other objects, advantages, and features of this invention will be apparent to those skilled in the art from a consideration of this specification, including the attached claims and appended drawings.

SUMMARY OF INVENTION

A power tong set, with lead and back-up tongs, is mounted on the slip bowl carrying structure of the traveling jack head of a snubbing unit and rotates with the slip bowl. Service lines (or umbelicals) for the tong set are not connected during string rotation.

In an alternate version of the apparatus a fluid feed through swivel is mounted on the tong set, secured to the necessary tong operating and control service fluid line, or lines, such that the tong set can rotate with tong service lines between the tong set and the snubbing unit attached during rotation.

In an alternate form, the tong set is mounted on the jack head, independently of the rotary table, and the tong set does not rotate when the rotary table rotates.

BRIEF DESCRIPTION OF DRAWINGS

In the drawings wherein like features have similar captions.

DETAILED DESCRIPTION OF DRAWINGS

Figure 1:
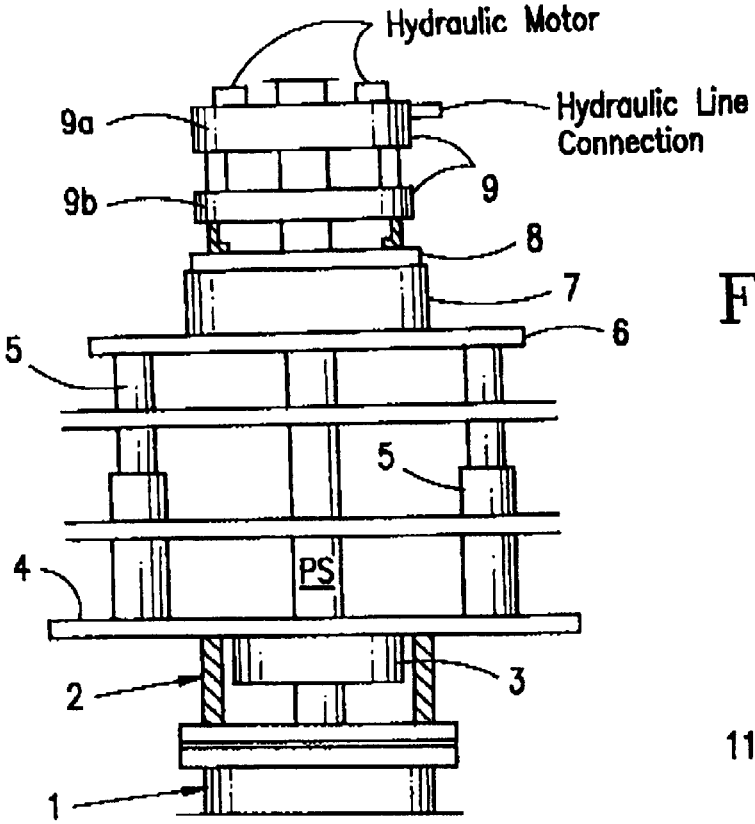
FIG. 1 is a side view of the overall assembly of a snubbing unit on a well head.

In the drawings, features that are well established in the art and do not bear upon points of novelty are omitted in the interest of descriptive clarity. Such omitted features may include threaded junctures, weld lines, sealing elements, pins and brazed junctures, hydraulic lines and couplers, slips and dies.

In the drawings, FIG. 1, shows a snubbing unit minus plumbing and electrical lines, and personnel safety features such as guard rails and the like, mounted on a well head. Well head 1 supports snubbing unit 2 which has platform 4 above the stationary slip bowl set up 3. Jack cylinders 5, normally hydraulic, support jack head 6 which moves up and down to axially manipulate pipe string PS. The jack head carries traveling slip bowl set 7. Tong set 9, comprising lead tongs 9*a* and backup tongs 9*b* is mounted on the rotating upper structure of the slip bowl set. An optional mounting convenience is the adapter plate 8 which can be drilled to fit a variety of slip bowl types.

The tong set 9, by current practice, is moved in and out of position to the usual tong work on the string PS. That requires people on the jack head and activities that adds danger to a hazardous work area.

With the arrangement of FIG. 1, people are still occasionally required on the jack head to connect and disconnect hydraulic lines to the tong set when connections are to be made on string PS but the activities related to hoisting and tong transfer to and from the jack head area are avoided.

Figure 2:
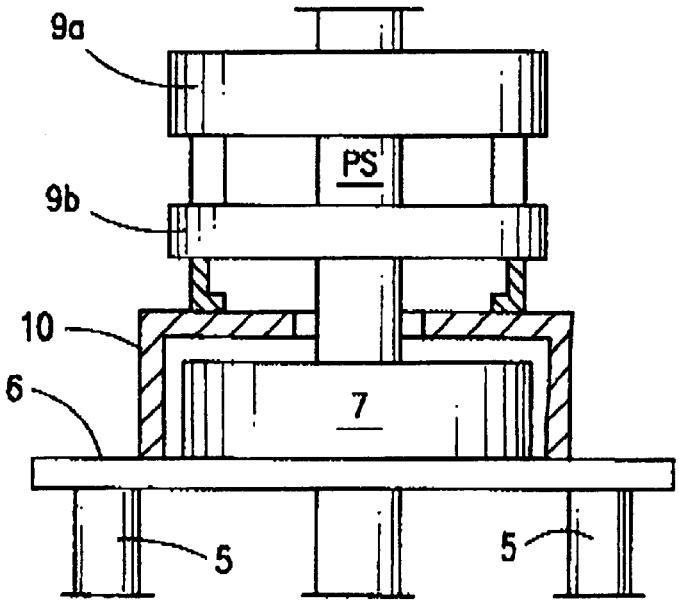
FIG. 2 is a side view, rather enlarged, of a portion of FIG. 1 with an alternate configuration of the invention.

In FIG. 2, further novel features include a structure 10 to mount the tong set on the jack head traveling base structure 6. This allows the slip bowls to rotate without rotating the tong set. Tong sets are often controlled by remote hydraulic control boxes. In this arrangement, the control box for this tong set can be positioned and operated from platform 4. People are not required on the jack head to operate the tongs. The tongs are not hoisted or moved into and out of the work area for routine work on the string.

Figure 3:
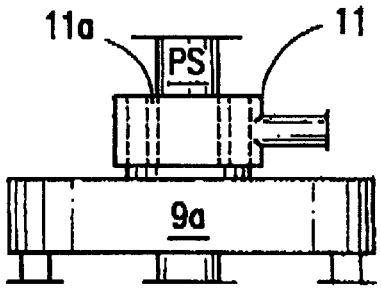
FIG. 3 is a side view rather enlarged showing the tong service swivel device related to FIG. 1 as an option.

In FIG. 3 a swivel unit is shown that allows the tongs to rotate without disconnecting the service, or umbelical, lines. Swivel 11 is shown with only one line but it is representative of the total lines subject to the need for a swivel. Swivel bore 11*a* accepts the tubular products being used in the string. The swivel structure is ruggedized to accept the occasional bash of tubular sections being handled.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

I claim:

1. Apparatus for making up and breaking out tubular member threaded connections, comprising:

a) a combined tong and backup unit comprising a power lead tong coupled to a backup tong, said combined tong and backup unit having a vertical axis substantially coincident with a central longitudinal axis of a tubular member when said tubular member is being gripped by said combined tong and backup unit, and, when viewed from above, said combined tong and backup unit being substantially symmetrical and balanced about at least one vertical plane intersecting said vertical axis, and further being substantially bisected by at least one other vertical plane intersecting said vertical axis; and b) a structure supporting said combined tong and backup unit, said structure adapted to in turn mount on a traveling jack head, whereby said combined tong and backup unit travels vertically along with said jack head, said structure being substantially centered about said vertical axis.

2. The apparatus of claim 1, wherein said combined tong and backup unit comprises closed head tongs.

* * * * *